US010259641B2

(12) United States Patent
Price et al.

(10) Patent No.: US 10,259,641 B2
(45) Date of Patent: Apr. 16, 2019

(54) PLURALITY OF INTERCONNECTED WIPES FOR USE IN DISPENSER

(71) Applicant: Kimberly-Clark Worldwide, Inc., Neenah, WI (US)

(72) Inventors: Kristina Marie Price, Neenah, WI (US); Sarah Elizabeth Knight, Cambridge (GB); Finbarr Charles Ronald Williamson, London (GB); Ryan Leslie Fulscher, Neenah, WI (US); Gerald Keith Sosalla, Appleton, WI (US); Kendall Jean Wendrick, Neenah, WI (US); Gary Alan Turchan, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/565,930

(22) PCT Filed: Oct. 23, 2015

(86) PCT No.: PCT/US2015/057177
§ 371 (c)(1),
(2) Date: Oct. 12, 2017

(87) PCT Pub. No.: WO2016/175887
PCT Pub. Date: Nov. 3, 2016

(65) Prior Publication Data

US 2018/0092496 A1 Apr. 5, 2018

Related U.S. Application Data

(60) Provisional application No. 62/154,961, filed on Apr. 30, 2015.

(51) Int. Cl.
*B65D 83/08* (2006.01)
*A47K 10/42* (2006.01)
*A47K 10/32* (2006.01)

(52) U.S. Cl.
CPC ..... *B65D 83/0894* (2013.01); *A47K 10/421* (2013.01); *B65D 83/0805* (2013.01);
(Continued)

(58) Field of Classification Search
CPC ..... B65D 83/0894; A47K 10/421
(Continued)

(56) References Cited

U.S. PATENT DOCUMENTS 361,603 A 4/1887 Wheeler
459,516 A * 9/1891 Wheeler ..... B32B 29/00 428/43

(Continued)

FOREIGN PATENT DOCUMENTS

DE 20314147 U1 12/2003
WO WO 1995/005111 A1 2/1995

(Continued)

OTHER PUBLICATIONS

Co-pending U.S. Appl. No. 15/565,927, filed Oct. 12, 2017, by Price et al. for "Plurality of Integrally Interconnected Wipes for Use in Dispenser."

(Continued)

*Primary Examiner* — Timothy R Waggoner
(74) *Attorney, Agent, or Firm* — Kimberly-Clark Worldwide, Inc.

(57) ABSTRACT

A plurality of stacked, interconnected wipes that collectively define a stack. Each wipe is connected to at least one other wipe on only one of the right side and the left side of the stack via a connection. In particular embodiments, immediately successive connections in a stacked direction are on (Continued)

alternating right and left sides of the stack. In other embodiments, immediately successive connections in a stacked direction are on the same side of the stack.

16 Claims, 14 Drawing Sheets

(52) U.S. Cl.
CPC .. *B65D 83/0835* (2013.01); *A47K 2010/3266* (2013.01); *A47K 2010/428* (2013.01)

(58) Field of Classification Search
USPC ..... 221/33–63
See application file for complete search history.

(56) References Cited

U.S. PATENT DOCUMENTS

| | | | | |
|---|---|---|---|---|
| 478,869 | A | 7/1892 | Jerome | |
| 2,823,089 | A | 2/1958 | De Franco | |
| 3,161,336 | A | 12/1964 | Loescher | |
| 4,899,905 | A | 2/1990 | Holtsch | |
| 4,982,845 | A | 1/1991 | Prascak et al. | |
| 5,041,317 | A | 8/1991 | Greyvenstein | |
| 5,114,771 | A | 5/1992 | Ogg et al. | |
| 5,332,118 | A | 7/1994 | Muckenfuhs | |
| 5,562,964 | A | 10/1996 | Jones | |
| 5,741,410 | A | 4/1998 | Tsurushima | |
| 5,899,447 | A | 5/1999 | Muckenfuhs | |
| 5,918,735 | A | 7/1999 | Bando et al. | |
| 5,981,013 | A | 11/1999 | Russ et al. | |
| 6,029,921 | A * | 2/2000 | Johnson | A47K 10/3818 242/160.1 |
| 6,139,932 | A | 10/2000 | Kline | |
| 6,228,454 | B1 | 5/2001 | Johnson et al. | |
| 6,368,689 | B1 | 4/2002 | Connor Sledge et al. | |
| 6,447,864 | B2 | 9/2002 | Johnson et al. | |
| 6,460,727 | B1 * | 10/2002 | Irwin | A47K 10/32 206/449 |
| 6,464,120 | B1 | 10/2002 | Johnson et al. | |
| 6,536,624 | B2 | 3/2003 | Johnson et al. | |
| 6,840,401 | B2 * | 1/2005 | Amundson | B65D 83/0805 206/494 |
| 6,991,840 | B2 * | 1/2006 | Sosalla | B65H 35/02 428/43 |
| 8,283,013 | B2 | 10/2012 | Feldmann et al. | |
| 8,298,640 | B2 * | 10/2012 | Cattacin | A47K 10/16 428/43 |
| 8,448,816 | B2 * | 5/2013 | Gordon | A47K 10/16 221/32 |
| 9,498,091 | B2 * | 11/2016 | Yamada | B65D 75/5894 |
| 2002/0074375 | A1 | 6/2002 | Irwin | |
| 2002/0155246 | A1 | 10/2002 | Johnson et al. | |
| 2005/0129898 | A1 | 6/2005 | Sosalla | |
| 2006/0273099 | A1 | 12/2006 | Abbosh et al. | |
| 2007/0098944 | A1 | 5/2007 | Mitchell | |
| 2008/0280088 | A1 | 11/2008 | Baum | |
| 2009/0212153 | A1 | 8/2009 | Alalu | |
| 2010/0075094 | A1 | 3/2010 | Cattacin et al. | |
| 2010/0264159 | A1 | 10/2010 | Gordon | |
| 2011/0031264 | A1 | 2/2011 | Marietta-Tondin | |
| 2011/0311749 | A1 | 12/2011 | McNeil et al. | |
| 2012/0237711 | A1 | 9/2012 | Cattacin et al. | |
| 2013/0040089 | A1 | 2/2013 | Cattacin et al. | |
| 2017/0037579 | A1 | 2/2017 | Marietta-Tondin et al. | |
| 2017/0100003 | A1 | 4/2017 | Yamada | |

FOREIGN PATENT DOCUMENTS

| | | | |
|---|---|---|---|
| WO | WO 2000/061458 | A1 | 10/2000 |
| WO | WO 2001/041613 | A1 | 6/2001 |
| WO | WO 2003/026472 | A1 | 4/2003 |
| WO | WO 2012/137018 | A1 | 10/2012 |
| WO | WO 2015/155563 | A1 | 10/2015 |

OTHER PUBLICATIONS

Co-pending U.S. Appl. No. 15/565,934, filed Oct. 12, 2017, by Price et al. for "Method of Dispensing a Plurality of Interconnected Wipes."

* cited by examiner

PLURALITY OF INTERCONNECTED WIPES FOR USE IN DISPENSER

BACKGROUND OF THE INVENTION

There is a variety of storing and dispensing containers in the market for wipes. Wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, hand wipes, personal care wipes, household cleaning wipes, industrial wipes and the like.

Conventional packages of wipes have typically been designed to be positioned on a flat surface such as a countertop, table or the like. Such conventional packages have often included a plastic container, tub or package which provides a sealed environment for the wet wipes to ensure that they do not become dirty or overly dry. Some of the conventional packages have also been configured to provide "one-at-a-time" dispensing of each wet wipe which can be accomplished using a single hand after the package has been opened. Such single-handed, one-at-a-time dispensing is particularly desirable because the other hand of the user or care giver is typically required to be simultaneously used for other functions. For example, when changing a diaper product on an infant, the care giver typically uses one hand to hold and maintain the infant in a desired position while the other hand is used to dispense a baby wipe to clean the infant.

"Pop-up" configurations of wet wipe dispensers can advantageously help provide the aforementioned single-handed, "one-at-a-time" dispensing. In "pop-up" configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes the leading wipe.

Historically, two malfunctions can occur during the operation just described. In one scenario, as the leading wipe is withdrawn, the leading wipe may not properly release from the succeeding wipe, with the result that the succeeding wipe is pulled too far or even entirely out of the package. A situation in which one or more succeeding wipes are in a single pull operation withdrawn from the package by virtue of being in operative contact with the leading wipe is referred to herein as "multiples." Multiples can result from excessively strong or geometrically ineffective connections between successive wipes (e.g., too much adhesive or insufficient web perforations), or can result from a dispensing orifice that does not sufficiently hold in place the succeeding wipe to allow the leading wipe to break free (e.g., too large of a dispensing orifice).

In another scenario, as the leading wipe is withdrawn, the succeeding wipe, after breaking free from the leading wipe, may not be readily accessible for subsequent dispensing. For example, although the leading end of the succeeding wipe may momentarily protrude from the package as it follows the leading wipe during withdrawal of the leading wipe, the leading end of the succeeding wipe often subsequently falls back through the dispensing orifice into the dispensing container—herein referred to as a "fallback." Fallbacks can result from insufficiently strong or geometrically ineffective connections between successive wipes (e.g., not enough adhesive or an excessively weak line of weakness), or can result from a dispensing orifice that does not sufficiently hold the leading edge of the succeeding wipe in an outwardly protruding manner (e.g., too large of a dispensing orifice). Occasionally, the succeeding wipe may entirely fail to exit the package as the leading wipe is withdrawn, such as when the connection between the leading wipe and the succeeding breaks prematurely (i.e.; before the leading wipe is fully withdrawn).

As a result, what is lacking in the art is a stack of wipes connected to one another in a manner that provides improved "pop-up" dispensing.

SUMMARY OF THE INVENTION

In a first embodiment, the invention provides a plurality of stacked, interconnected wipes that collectively define a stack. The stack has a right end, a left end, a transverse direction extending between the right end and the left end, a longitudinal direction perpendicular to the transverse direction, and a longitudinal centerline extending in the longitudinal direction and positioned midway between the right and left ends. The stack defines a right side transversely between the longitudinal centerline and the right end and defines a left side transversely between the longitudinal centerline and the left end. Each wipe is connected to at least one other wipe on only one of the right side and the left side of the stack via a connection.

In a second embodiment, the invention provides the plurality of wipes of the first embodiment wherein immediately successive connections in a stacked direction are on alternating right and left sides of the stack.

In a third embodiment, the invention provides the plurality of wipes of the first embodiment wherein immediately successive connections in a stacked direction are on the same side of the stack.

In a fourth embodiment, the invention provides a plurality of stacked, interconnected wipes that collectively define a stack. The stack has a right end, a left end, a transverse direction extending between the right end and the left end, a longitudinal direction perpendicular to the transverse direction, and a longitudinal centerline extending in the longitudinal direction and positioned midway between the right and left ends. The stack defines a right side transversely between the longitudinal centerline and the right end and defines a left side transversely between the longitudinal centerline and the left end. The plurality of wipes includes a first wipe, a second wipe, and a third wipe. A right-side connection connects the first wipe to the second wipe in the right side of the stack, and the right-side connection has an effective width extending in the transverse direction. The first wipe is connected to the second wipe only on the right side. A left-side connection connects the second wipe to the third wipe in the left side of the stack, and the left-side connection has an effective width extending in the transverse direction. The second wipe is connected to the third wipe only on the left side.

In a fifth embodiment, the invention provides the plurality of wipes of the fourth embodiment wherein the right-side connection effective width and the left-side connection effective width are each at most 10 percent of a stack transverse width.

In a sixth embodiment, the invention provides the plurality of wipes of either of the fourth and fifth embodiments wherein the majority of right-side connections and the majority of left side connections each include from 3 to 8 bridging strips.

In a seventh embodiment, the invention provides a plurality of stacked, interconnected wipes that collectively define a stack. The stack has a right end, a left end, a transverse direction extending between the right end and the left end, a longitudinal direction perpendicular to the transverse direction, and a longitudinal centerline extending in the longitudinal direction and positioned midway between the right and left ends. The stack defines a right side transversely between the longitudinal centerline and the right end and defines a left side transversely between the longitudinal centerline and the left end. The plurality of wipes includes a first wipe, a second wipe, and a third wipe. A first right-side connection connects the first wipe to the second wipe in the right side of the stack, and the first right-side connection has an effective width extending in the transverse direction. The first wipe is connected to the second wipe only on the right side. A second right-side connection connects the second wipe to the third wipe in the right side of the stack, and the second right-side connection has an effective width extending in the transverse direction. The second wipe is connected to the third wipe only on the right side.

In an eighth embodiment, the invention provides the plurality of wipes of the seventh embodiment wherein the first right-side connection effective width and the second right-side connection effective width are each at most 10 percent of a stack transverse width.

In a ninth embodiment, the invention provides the plurality of wipes of the seventh or eighth embodiments wherein an entirety of each connection in the stack is closer to the stack right end than to the longitudinal centerline of the stack.

In a tenth embodiment, the invention provides the plurality of wipes of any of the seventh through ninth embodiments wherein the majority of connections each include from 3 to 8 bridging strips.

In an eleventh embodiment, the invention provides the plurality of wipes of any of the first through sixth embodiments wherein an entirety of each right-side connection in the stack is closer to the stack right end than to the longitudinal centerline of the stack, and wherein an entirety of each left-side connection in the stack is closer to the stack left end than to the longitudinal centerline of the stack.

In a twelfth embodiment, the invention provides the plurality of wipes of any of the first through eleventh embodiments wherein a majority of connections in the stack are integrally formed with a wipe.

In a thirteenth embodiment, the invention provides the plurality of wipes of any of the first through eleventh embodiments wherein no connection in the stack is integrally formed with a wipe.

In a fourteenth embodiment, the invention provides the plurality of wipes of the thirteenth embodiment wherein each connection is accomplished via ultrasonic bonding, heat bonding or pressure bonding.

In a fifteenth embodiment, the invention provides a dispenser containing the plurality of wipes of any of the first through fourteenth embodiments, the dispenser and plurality of wipes together adapted to provide pop-up dispensing of wipes, the dispenser defining a dispensing orifice, wherein the dispensing orifice is transversely offset from the longitudinal centerline toward the right end by at least 25 percent of a stack transverse width.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the items depicted in the drawings are referred to by the same reference numerals.

DETAILED DESCRIPTION OF THE INVENTION

Figure 1:
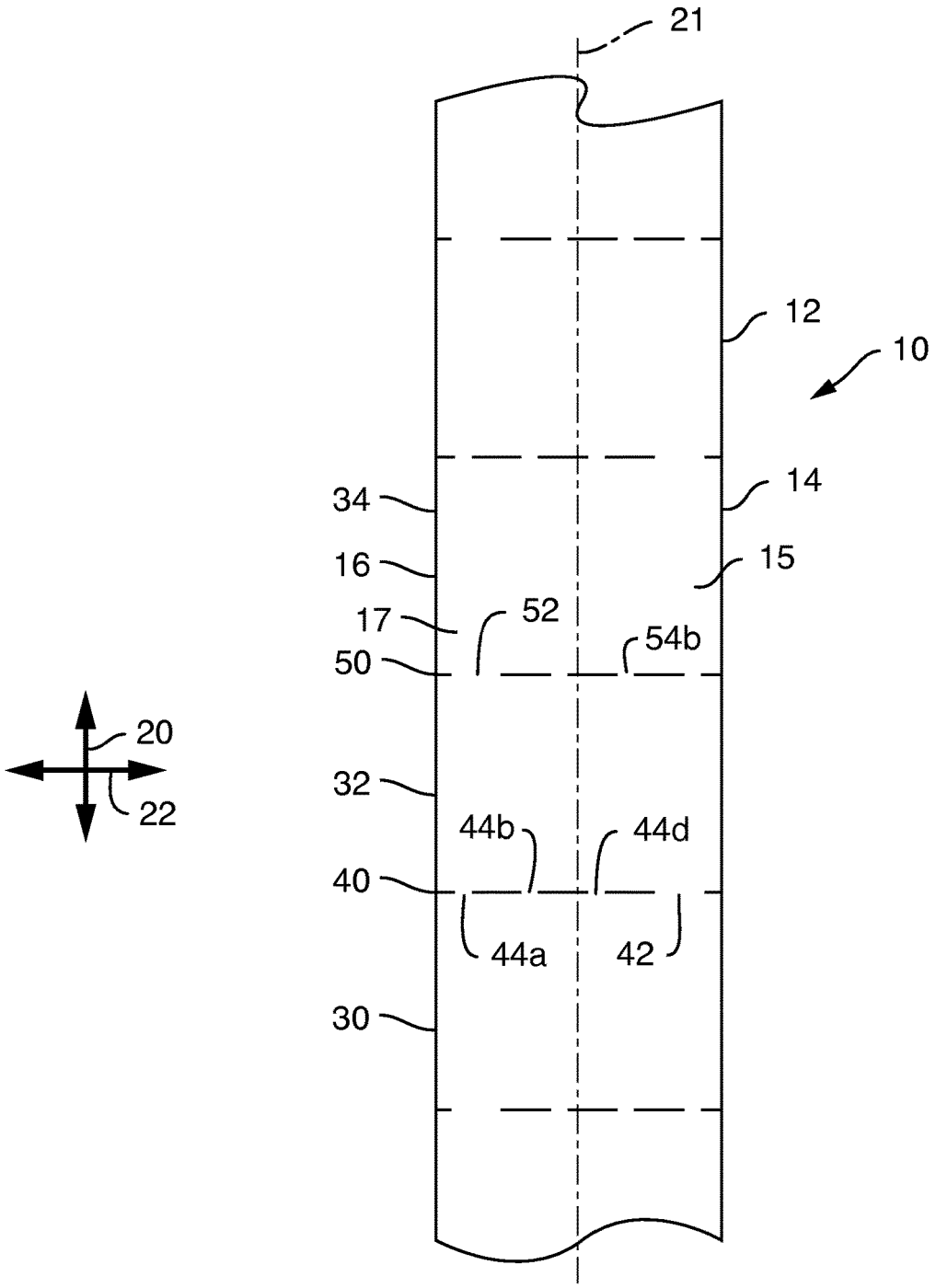
FIG. 1 representatively shows a portion of a plurality of integrally interconnected wipes according to one embodiment of the invention.

The present invention will be more fully understood and further features will become apparent when reference is made to the following detailed description of the invention and the accompanying drawings. The drawings are merely representative and are not intended to limit the scope of the claims. Like parts of the packages depicted in the drawings are referred to by the same reference numerals.

Referring to FIGS. 1-6, a plurality 10 of integrally interconnected wipes collectively define a web 12. The web has a right edge 14, a left edge 16, a longitudinal direction 20 extending parallel to the right edge 14 and the left edges 16, a transverse direction 22 perpendicular to the longitudinal direction 20, and a longitudinal centerline 21 extending in the longitudinal direction 20 and positioned midway between the right edge 14 and the left edge 16. The web defines a right side 15 transversely between the centerline 21 and the right edge 14, and the web defines a left side 17 transversely between the centerline 21 and the left edge 16. As shown in the Figures, the plurality 10 of wipes includes at least a first wipe 30, a second wipe 32, and a third wipe 34.

Figure 2A:
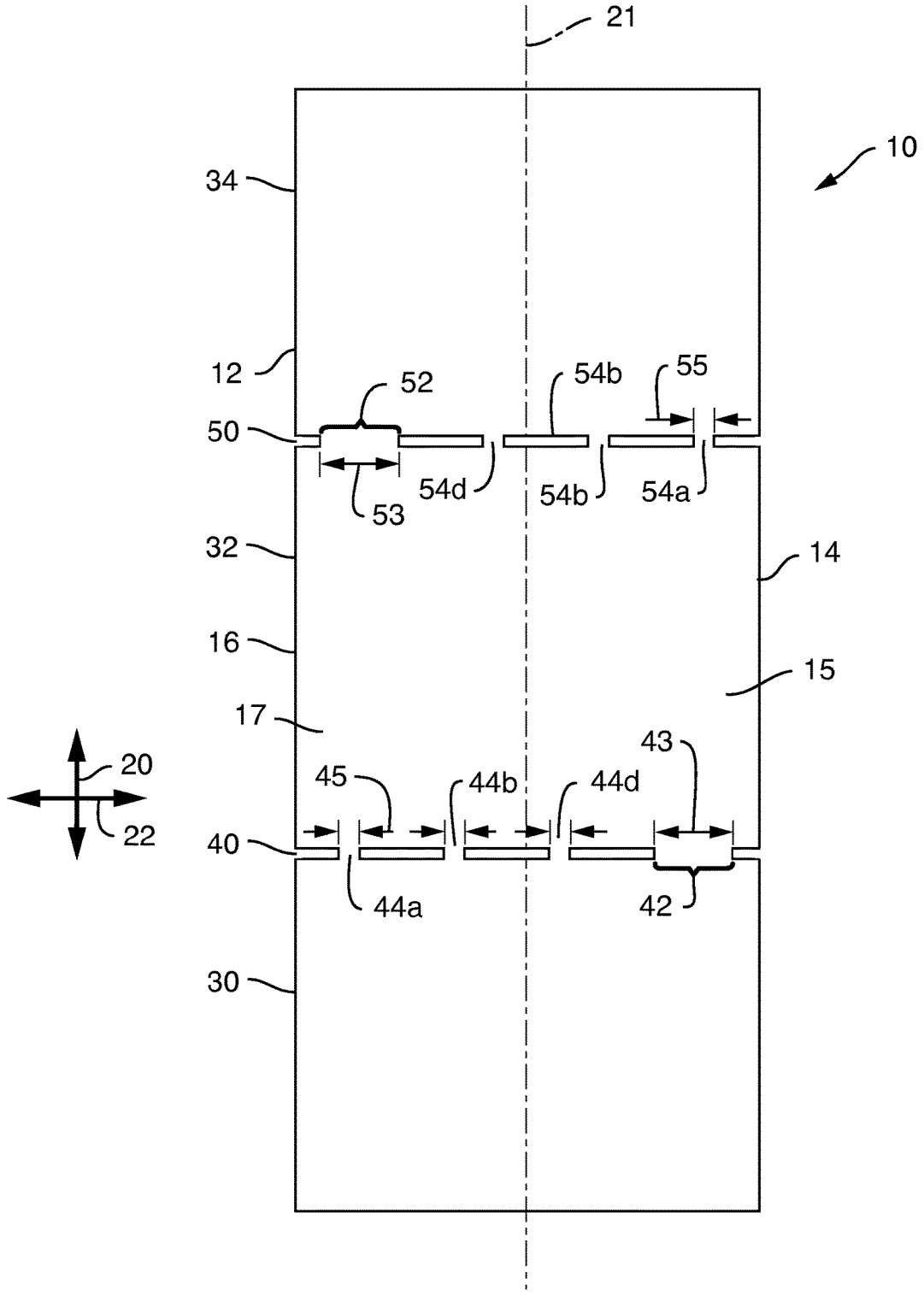
FIG. 2A representatively shows a close-up view of a portion of the embodiment of FIG. 1.
Figure 2B:
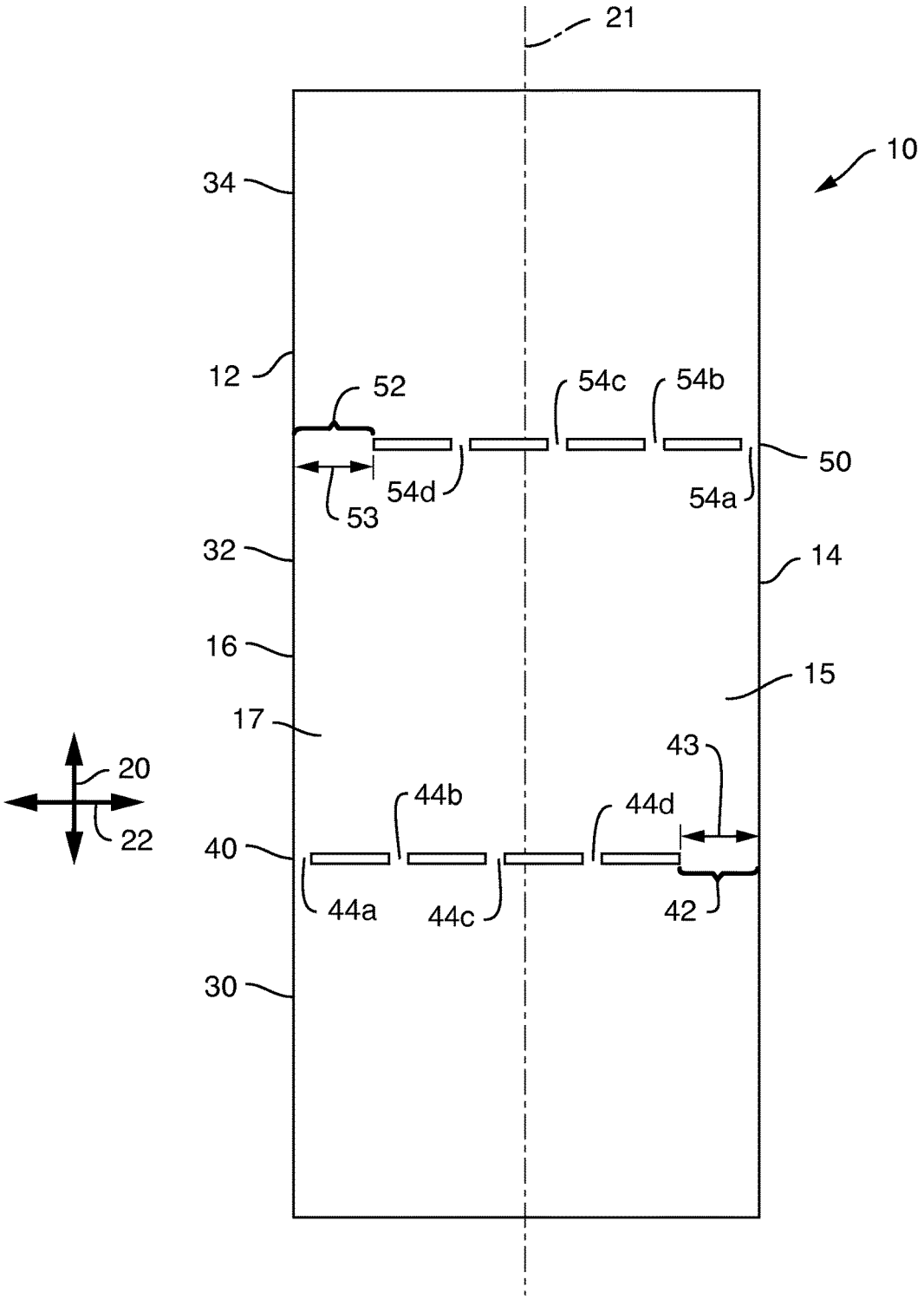
FIG. 2B representatively shows an alternative embodiment of the portion shown in FIG. 2A.
Figure 3:
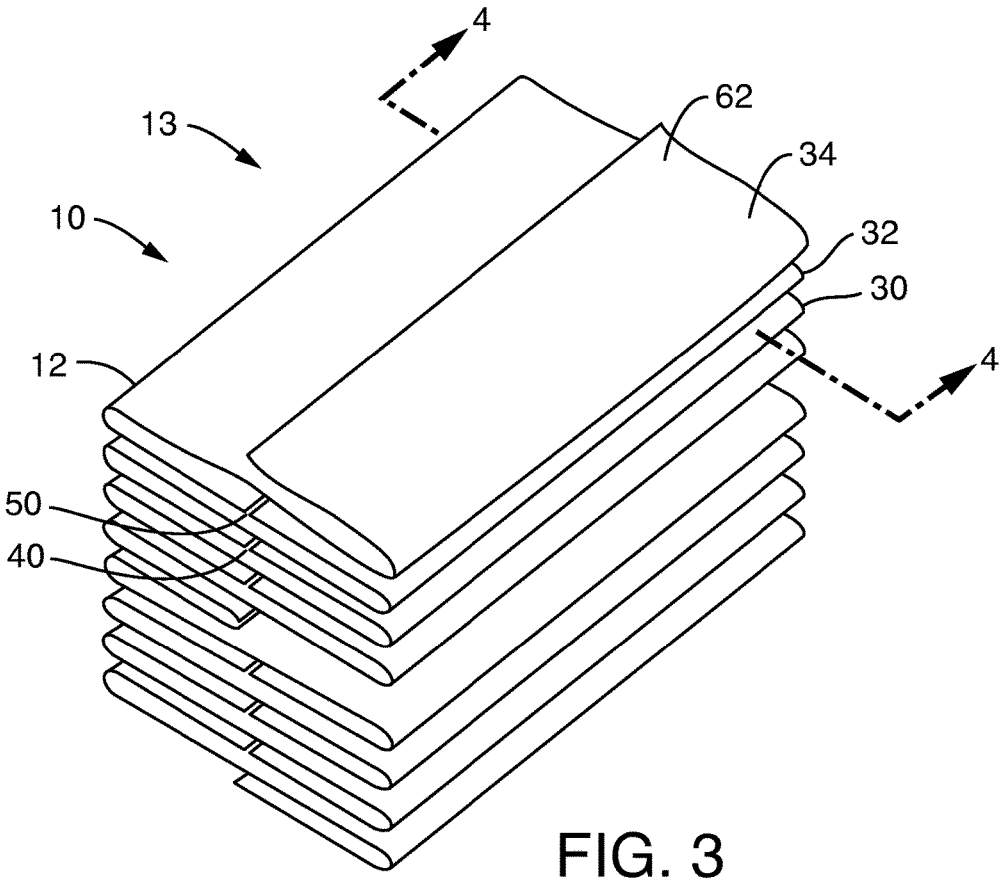
FIG. 3 representatively shows a perspective view of a stack of folded, integrally interconnected wipes, similar to those shown in FIG. 1.

In particular embodiments, as representatively illustrated in FIGS. 1-3, a first transverse intermittent cut line 40 extends across the web 12. The first transverse intermittent cut line 40 partitions the web 12 into two longitudinally adjacent wipes—namely, the first wipe 30 and the second wipe 32. The first transverse intermittent cut line 40 defines a right side major tie 42, and in particular embodiments a left side minor tie 44*a*. The right side major tie 42 and the left side minor tie 44*a* together connect the first wipe 30 to the second wipe 32. The right side major tie 42 has a width 43, and the left side minor tie 44*a* has a width 45. Both widths 43, 45 extend in the transverse direction 22. The width 43 of the right side major tie 42 is greater than the width 45 of the left side minor tie 44*a*.

In particular embodiments, a second transverse intermittent cut line 50 extends across the web 12. The second transverse intermittent cut line 50 partitions the web 12 into two longitudinally adjacent wipes—namely, the second wipe 32 and the third wipe 34. The second transverse intermittent cut line 50 defines a left side major tie 52, and in particular embodiments a right side minor tie 54*a*. The left side major tie 52 and the right side minor tie 54*a* together connect the second wipe 32 to the third wipe 34. The left side major tie 52 has a width 53, and the right side minor tie 54*a* has width 55. Both widths 53, 55 extend in the transverse direction 22. The width 53 of the left side major tie 52 is greater than the width 55 of the right side minor tie 54*a*. Note that the cut lines 40, 50 may be straight, wavy, zig-zag, or otherwise non-straight. Also, the cut lines 40, 50 may travel a path that is parallel to the transverse direction 22, or that is not parallel to the transverse direction 22, such as tilted relative to the transverse direction 22.

In particular embodiments, such as that representatively illustrated in FIGS. 1 and 2A, the right side major tie 42 is spaced from the right edge 14 by at least 1 millimeter, more particularly at least 3 millimeters, still more particularly at least 5 millimeters, and still more particularly at least 10 millimeters, and the left side major tie 52 is spaced from the left edge 16 by at least 1 millimeter, more particularly at least 3 millimeters, still more particularly at least 5 millimeters, and still more particularly at least 10 millimeters. In other embodiments, such as that representatively illustrated in FIG. 2B, the right side major tie 42 abuts the right edge 14, and the left side major tie 52 abuts the left edge 16.

In particular embodiments (FIGS. 1, 2A, 2B), the first transverse intermittent cut line 40 defines at least two left side minor ties 44*a*, 44*b*, and the second transverse intermittent cut line 50 defines at least two right side minor ties 54*a*, 54*b*. In particular embodiments (FIG. 2B), the first transverse intermittent cut line 40 defines at least three left side minor ties 44*a*, 44*b*, 44*c*, and the second transverse intermittent cut line 50 defines at least three right side minor ties 54*a*, 54*b*, 54*c*. In particular embodiments, the first transverse intermittent cut line 40 defines at least one right side minor tie 44*d*, and the second transverse intermittent cut line 50 defines at least one left side minor tie 54*d*.

In particular embodiments, the width 43/53 of each major tie 42/52 is between about 2 and 15 millimeters wide, and more particularly between about 2 and 10 millimeters wide. In particular embodiments, the major tie is more than 3 millimeters wide, more particularly more than 4 millimeters wide, still more particularly more than 5 millimeters wide, and still more particularly more than 8 millimeters wide. Additionally or alternatively, in particular embodiments, the width 45/55 of each minor tie 44/54 is between about 0.5 and 3 millimeters wide. In particular embodiments, the minor tie is less than 3 millimeters wide, more particularly less than 2 millimeters wide, and still more particularly less than 1 millimeter wide. In particular embodiments, the width 45/55 of each major tie 42/52 is at least three times greater that the width 45/55 as each minor tie 43/53.

In another aspect of the invention, a dispenser 11 contains the plurality 10 of integrally interconnected wipes described above. The dispenser 11 and plurality 10 of wipes are together adapted to provide pop-up dispensing of wipes. Examples of dispensers suitable for use in conjunction with particular embodiments of the present invention include those described in U.S. Pat. No. 6,523,690 B1; U.S. Pat. App. Pub. 2014/0174974 A1; U.S. Pat. App. Pub. 2014/0001072 A1; and U.S. Pat. App. Pub. 2014/0374432 A1, each of which is hereby incorporated by reference to the extent not inconsistent herewith.

The dispenser 11 can include any suitable number of individual wipes depending upon the dispenser size and intended end use. For example, the dispenser can be configured to include a stack of wipes which can include at least about 5 wipes and desirably from about 8 to about 320 individually wipes, and more desirably from about 16 to about 64 wipes. The size and shape of the stack of wipes is dependent upon the size and shape of the dispenser and vice versa.

Figure 4:
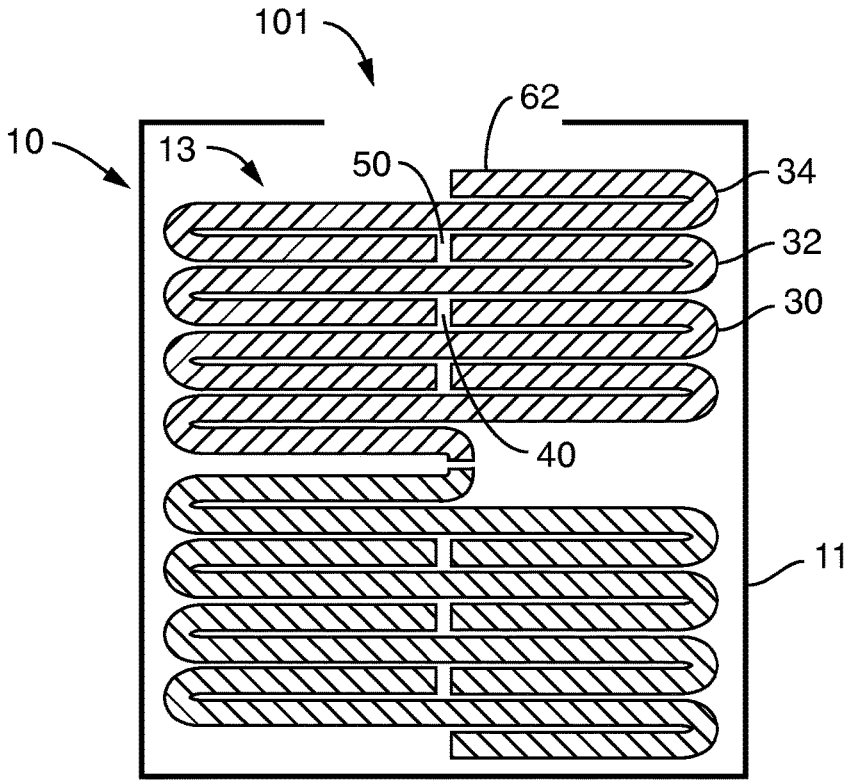
FIG. 4 representatively shows a cross-sectional view of the stack of wipes illustrated in FIG. 3, taken along the line 4-4.
Figure 5:
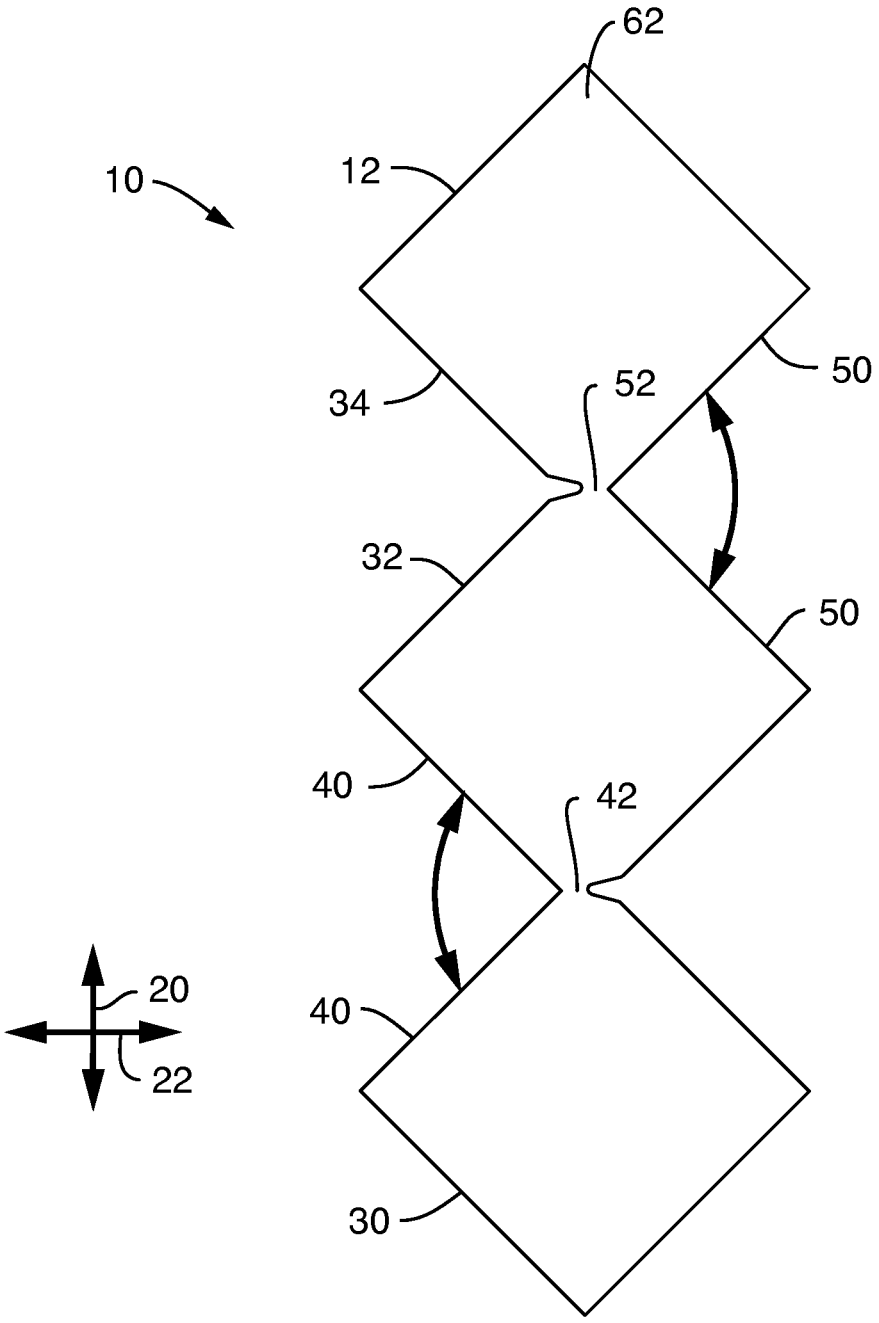
FIG. 5 representatively shows the plurality of integrally interconnected wipes shown in FIG. 2B, elongated and with the minor ties torn.
Figure 6:
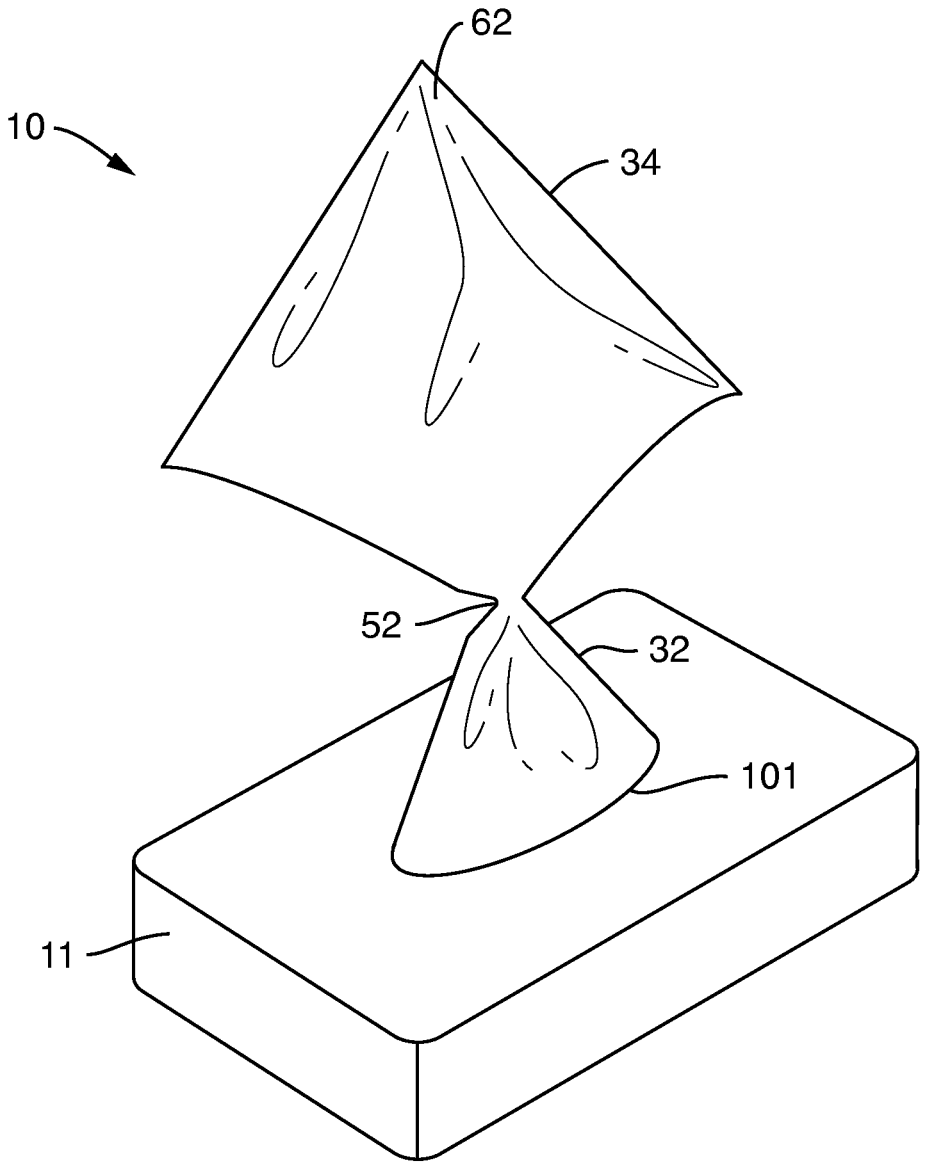
FIG. 6 representatively shows a perspective view of an example of a dispenser for wipes suitable for use in conjunction with particular embodiments of the present invention FIG. 7 representatively shows a plurality of integrally interconnected wipes according to an alternative embodiment of the invention.

In particular embodiments, the plurality 10 of integrally interconnected wipes are arranged in a stack 13, as representatively illustrated in FIGS. 3 and 4. The example shown in FIGS. 3 and 4 employs an accordion-like stack 13. The individual wipes can be connected together at transverse intermittent cut lines 40, 50 as described above. The transverse intermittent cut lines can be provided by means known to those skilled in the art, such as perforations, indentations, or cuts in the web of material. For example, the cut lines can be provided in the web of material by passing the web of material between a die cutter roll and an anvil roll. In the illustrated embodiment, the transverse intermittent cut lines are position in the middle of the stack of fold wipes, which is advantageous when dispensing from dispensers with centrally located dispensing orifices. In alternative embodiments (not shown), the intermittent cut lines can be positioned "off center," or at the edge of the stack.

The purpose, in particular embodiments, of the major ties described above is to deliver enhanced pop-up dispensing. The purpose of the minor ties is to facilitate commercial manufacture of the wipes. Specifically, it is common for wipe products to be formed as very long, continuous webs or sheets. Examples of suitable materials are described below. After the continuous sheet is formed, the sheet typically travels through additional processing steps, including, for example, drying, calendaring, embossing, wrinkle removing, slitting, perforating, and winding. During such additional processing steps, the continuous sheet generally is under both longitudinal and lateral tension. If adjacent wipes were integrally interconnected only by the major ties described herein, consistent, reliable handling of the continuous sheet would be compromised, because the major ties alone would not provide sufficient strength and integrity to the continuous sheets for commercial, high-speed, tensioned processing. Introduction of the minor ties as described herein allows for more robust handling of the continuous sheets during the manufacturing. In this way, the major and minor ties together allow for the practical commercial manufacture of an optimized pop-up dispensing experience.

Another way to articulate key features of particular embodiments of the invention is as follows. The web 12 includes a plurality of transverse intermittent cut lines (e.g., 40, 50). The cut lines are spaced apart from each other in the longitudinal direction 20 to define individual wipes (e.g., 30/32/34). Each cut line (e.g., 40/50) defines a major tie (e.g., 42/52) and a minor tie (e.g., 44/54), and the major tie and the minor tie are on opposite sides of the longitudinal centerline 21. The width 43 of the major tie 42 is greater than the width 53 of the minor tie. The major ties (e.g., 42/52) in longitudinally successive pluralities of cut lines (e.g., 40, 50) are on alternating right and left sides (15, 17) of the longitudinal centerline 21. In this way, a plurality of major ties are arranged on the web 12 in a "zig-zag" pattern in the longitudinal direction, as representatively illustrated in FIG. 1.

The plurality 10 of wipes integrally interconnected as heretofore described can in particular embodiments deliver an improved dispensing experience. As the leading corner 62 of a wipe at the top of a stack 13, such as, referring to FIGS. 3-4, wipe 34, is pulled by the user, a chain of events begins. First, the one or more minor ties 52 are torn as the wipe 34 is pulled upward from the stack. As the one or more minor ties 52 are torn, the wipe 34 begins to tilt to the side, or even assume a diamond shape, as representatively illustrated in FIGS. 5 and 6. As the succeeding wipe 32 begins to lift from the stack, in particular embodiments the stack 13 and/or dispenser 11 are configured to promote a tearing of the major tie 42, thus fully releasing wipe 34 from the web 12.

Figure 10A:
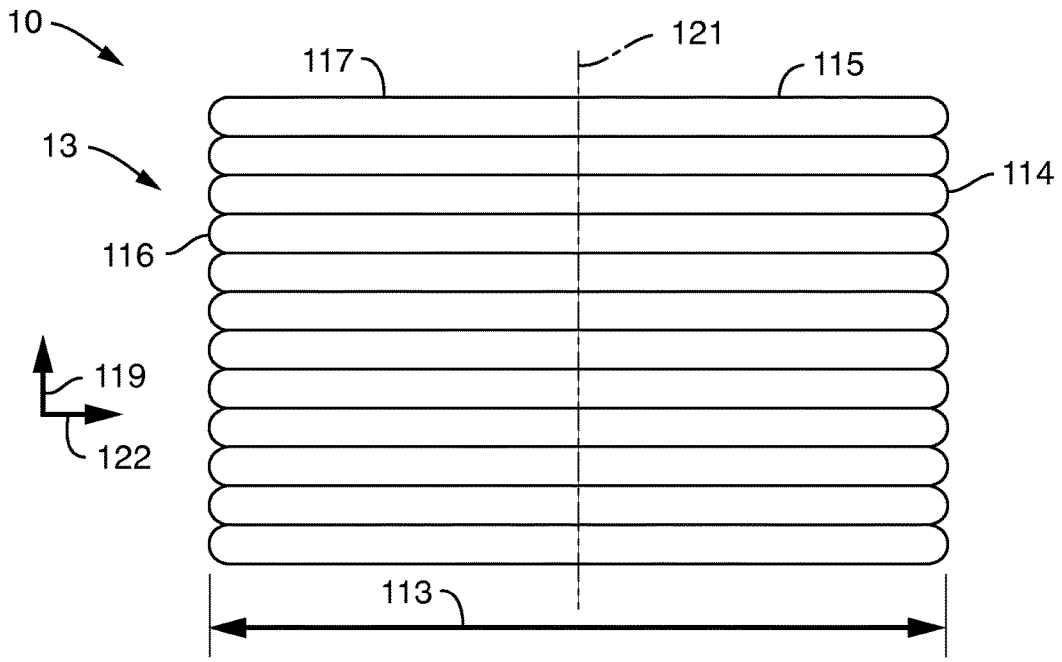
FIG. 10A representatively shows a front view of a stack of folded, interconnected wipes, such as those shown any of FIGS. 1-3 and 7-9.
Figure 10B:
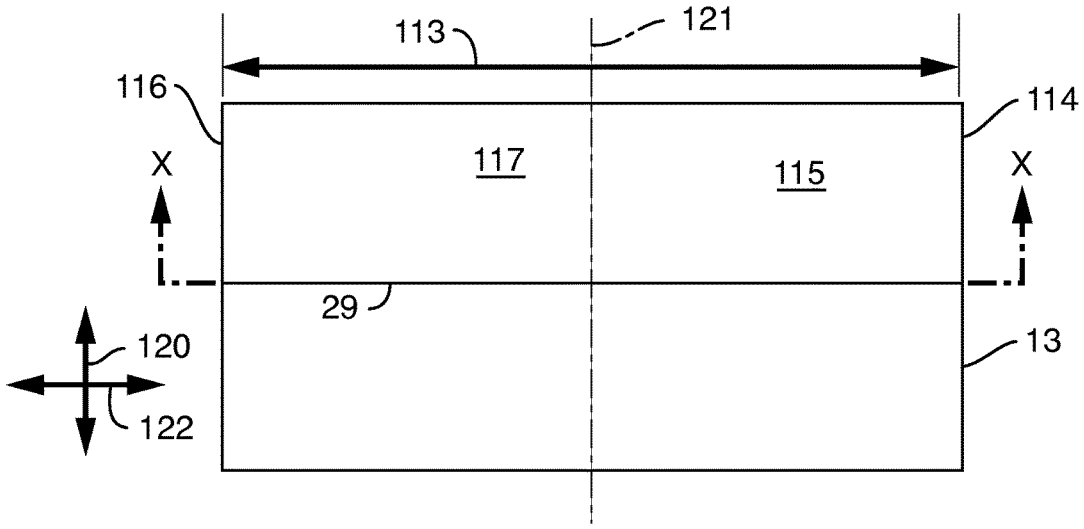
FIG. 10B representatively shows a top view of a stack of folded, interconnected wipes, such as those shown in any of FIGS. 1-3 and 7-9.

Referring to FIGS. 10A-10D, the present invention includes in particular embodiments a plurality of stacked, interconnected wipes 10 that collectively define a stack 13. The stack 13 has a right end 114, a left end 116, a transverse direction 122 extending between the right end 114 and the left end 116, a longitudinal direction 120 perpendicular to the transverse direction 122, and a longitudinal centerline 121 extending in the longitudinal direction 120 and positioned midway between the right end 114 and left end 116. The stack 13 defines a right side 115 transversely between the longitudinal centerline 121 and the right end 114 and defines a left side 117 transversely between the longitudinal centerline 121 and the left end 116. In the exemplary embodiments shown in FIGS. 10A-10D, each of the wipes is folded in half in the longitudinal direction 120. FIG. 10B shows a top view of the stack of folded wipes of FIG. 10A. The leading edge 29 of the wipe on the top of the stack 13 can be seen in FIG. 10B.

Figure 7:
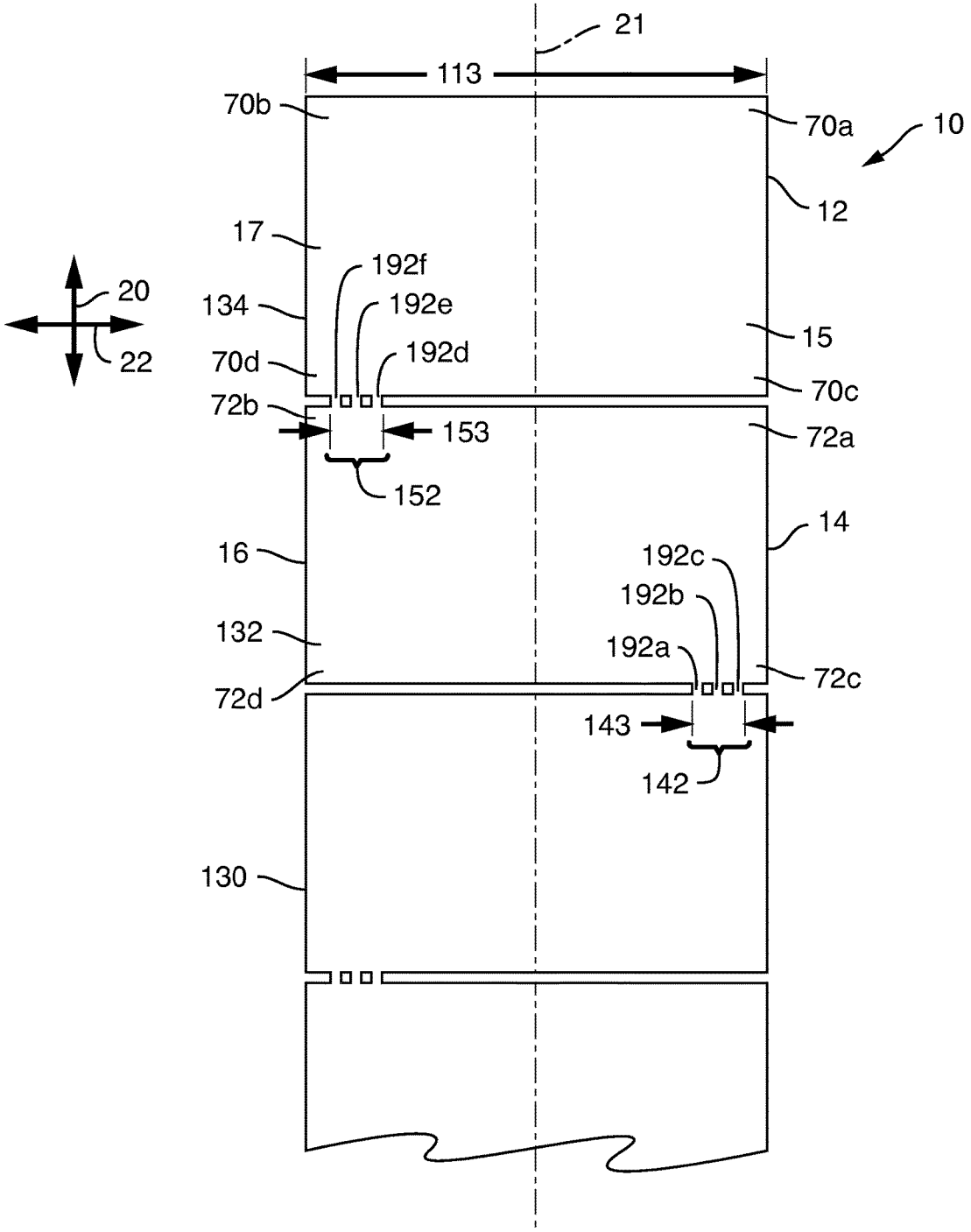
Figure 8:
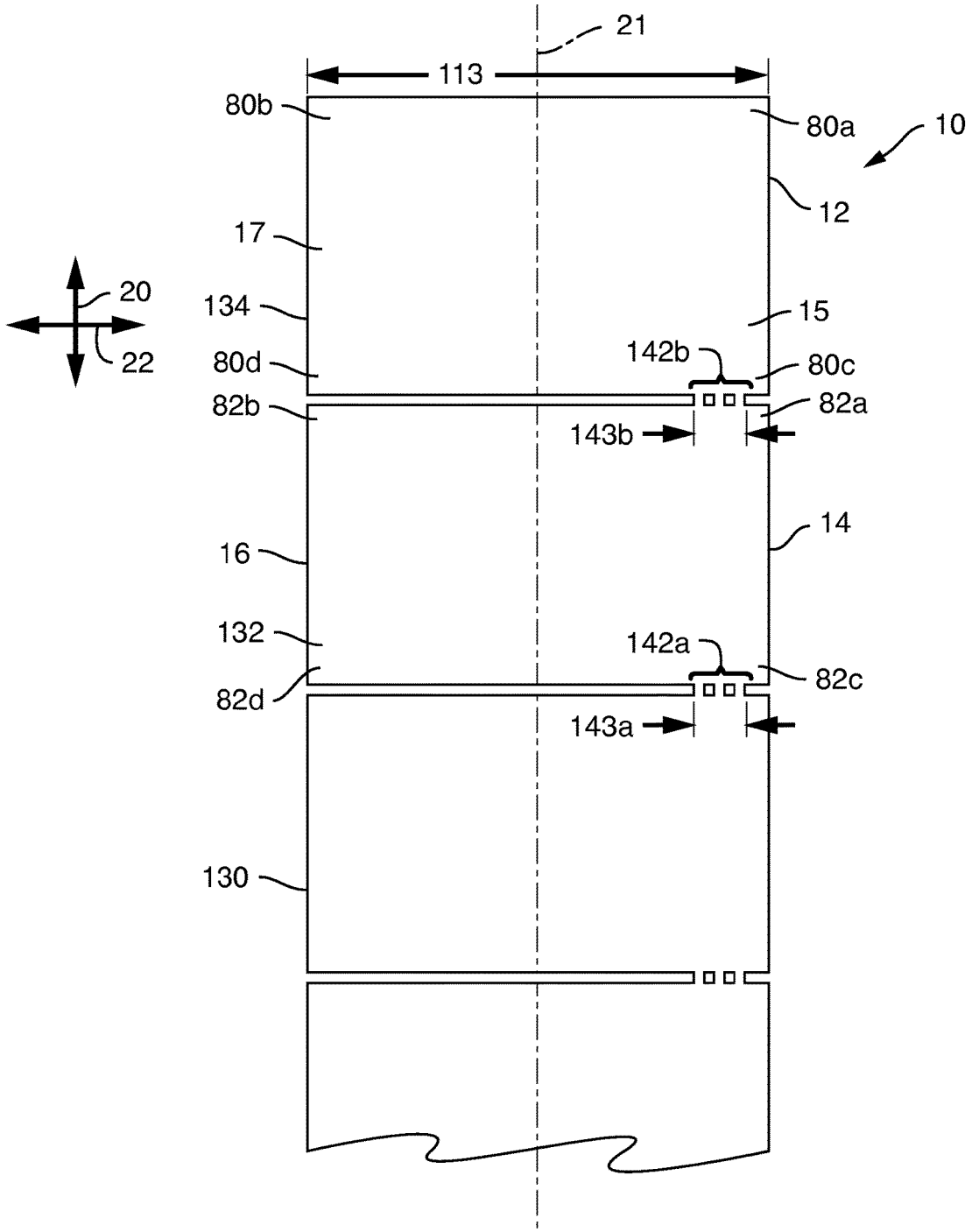
FIG. 8 representatively shows a plurality of integrally interconnected wipes according to yet another embodiment of the invention.
Figure 9:
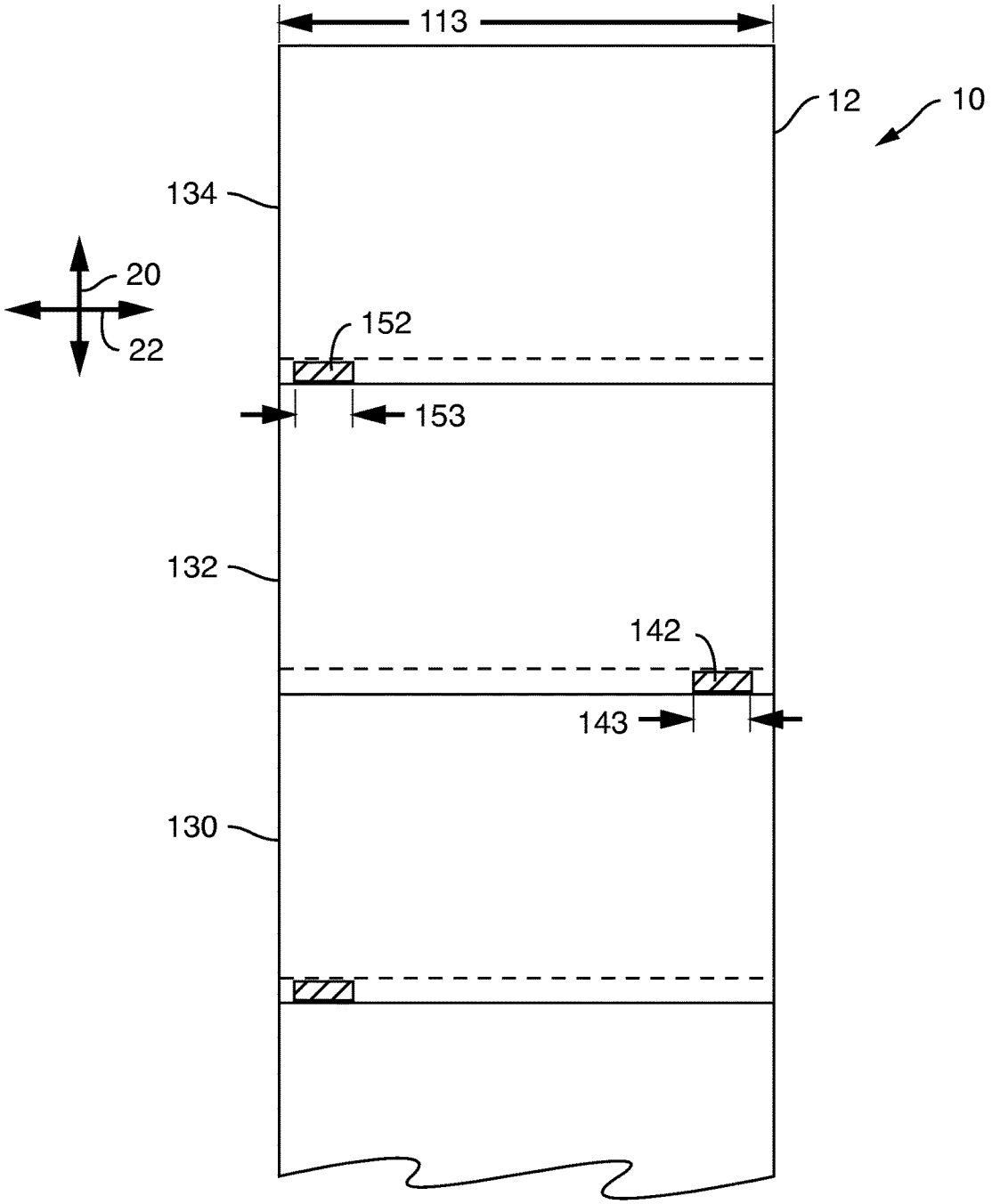
FIG. 9 representatively shows a plurality of non-integrally interconnected wipes according to one embodiment of the invention.
Figure 10C:
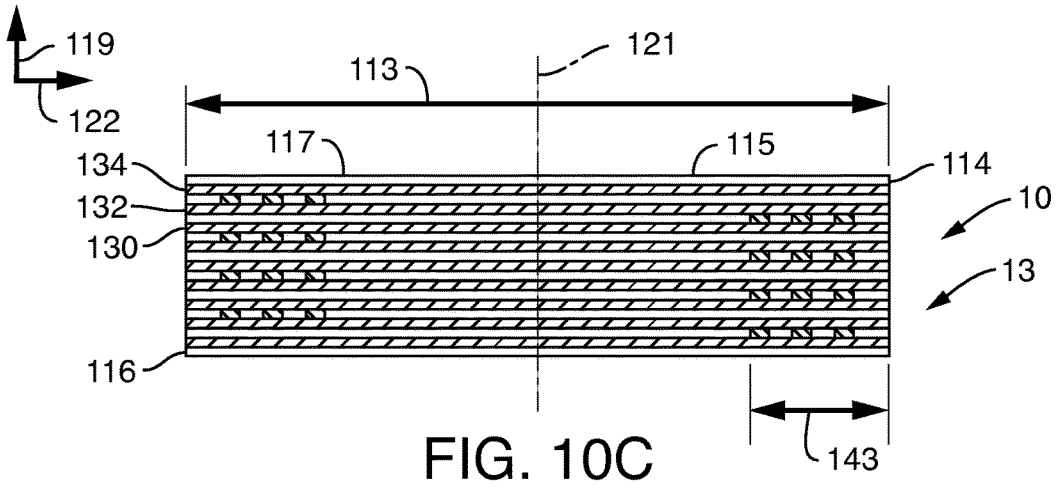
FIG. 10C representatively shows a cross-sectional view of one embodiment of a stack of wipes as seen along line X-X in FIG. 10B, in which wipe-to-wipe connections are on alternating sides of the stack.
Figure 10D:
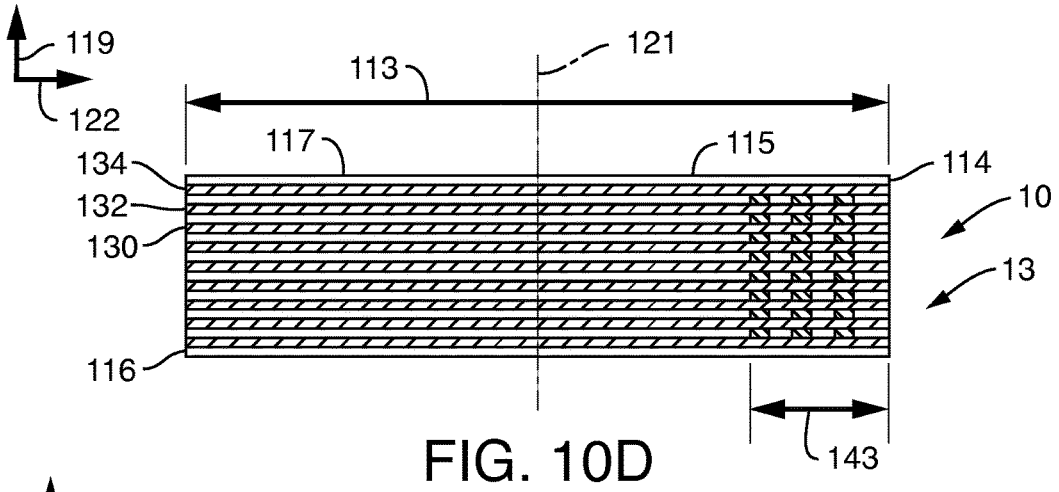
FIG. 10D representatively shows a cross-sectional view of an alternative embodiment of a stack of wipes as seen along line X-X in FIG. 10B, in which wipe-to-wipe connections are all on the same side of the stack.

As representatively illustrated in FIGS. 7-9, 10C, and 10D, in particular embodiments, each wipe is connected to at least one other wipe on only one of the right side 115 and the left side 117 of the stack 13 via a connection. In particular embodiments, such as those depicted in FIGS. 7, 9, and 10C, immediately successive connections in a stacked direction 119 are on alternating right and left sides 115, 117 of the stack 13. In other embodiments, such as those depicted in FIGS. 8 and 10D, immediately successive connections in a stacked direction 119 are on the same side of the stack (e.g., the right side 115 as shown in FIG. 10D). FIG. 7 depicts several interconnected wipes from the stack shown in FIG. 10C, and FIG. 8 depicts several interconnected wipes from the stack shown in FIG. 10D, with the interconnected plurality in each case unfolded and fully extended to show various features.

For example, referring to FIGS. 7, 9, and 10C, in particular embodiments, a plurality of wipes 10 includes a first wipe 130, a second wipe 132, and a third wipe 134. A right-side connection 142 connects the first wipe 130 to the second wipe 132 in the right side 115 of the stack 13. The first wipe 130 is connected to the second wipe 132 only on the right side 115 of the stack 13. Also, a left-side connection 152 connects the second wipe 132 to the third wipe 134 in the left side 117 of the stack 13. The second wipe 132 being connected to the third wipe 134 only on the left side 117 of the stack 13.

In another example, referring to FIGS. 8 and 10D, in particular embodiments, a plurality of wipes 10 includes a first wipe 130, a second wipe 132, and a third wipe 134. A first right-side connection 142*a* connects the first wipe 130 to the second wipe 132 in the right side 115 of the stack 13. The first wipe 130 is connected to the second wipe 132 only on the right side 115 of the stack 13. Also, a second right-side connection 142*b* connects the second wipe 132 to the third wipe 134 in the right side 115 of the stack 13. The second wipe 132 is connected to the third wipe 134 only on the right side 115 of the stack 13. FIG. 8 depicts several interconnected wipes from a stack somewhat similar to the one shown in FIG. 10D, with the interconnected plurality unfolded and fully extended to show various features.

In particular embodiments, such as those representatively illustrated in FIGS. 7, 8, 10C, and 10D, a majority of wipe-to-wipe connections in the stack 13 of wipes are integrally formed with a wipe. For example, the connections 142 and 152 can each include three bridging strips 192. The bridging strips 192*a*, 192*b*, and 192*c* collectively define the right-side connection 142, and the bridging strips 192*d*, 192*e*, and 192*f* collectively define the left-side connection 152. The number of bridging strips can be varied depending on the dispensing mechanics necessitated by the specific configuration and construction of the wipes—and in particular embodiments, the dispenser—involved. In particular embodiments, each connection 142, 152 includes from 2 to 10 and more particularly from 3 to 8 bridging strips. Preferably, in particular embodiments, each bridging strip is from 1 to 5 millimeters in transverse with, and more preferably each bridging strip is from 1.5 to 3 millimeters in transverse width. In other embodiments, no wipe-to-wipe connection in the stack is integrally formed with a wipe. For example, referring to FIG. 9, the connections 142 and 152 are accomplished via energy bonding. Example of suitable energy bonding included ultrasonic bonding, heat bonding, or pressure bonding. The bonding could also be accomplished via a bonding material, such as adhesive.

The stack has a width 113 measured in the transverse direction 122. The right-side connection 142 has an effective width 143 extending in the transverse direction 122, and the left-side connection 152 has an effective width 153 extending in the transverse direction 122. The "effective width" is the distance in the transverse direction between the two furthest-apart points of connectivity that connect immediately successive wipes in a stack within a single side 115, 117 of the stack 13. Thus, in no case can the effective width of a connection be greater than half of the stack transverse width 113. Preferably, the effective width of a connection is considerably less than half of the stack transverse width. For example, in particular embodiments, referring to FIGS. 7 and 9, the right-side connection effective width 143 and the left-side connection effective width 153 are each at most 10 percent of a stack transverse width 113. In another example, referring to FIG. 8, the first right-side connection effective width 143*a* and the second right-side connection effective width 143*b* are each at most 10 percent of a stack transverse width 113.

In particular embodiments, an entirety of each right-side connection 142 in the stack 13 is closer to the stack right end 114 than to the longitudinal centerline 121 of the stack 13, and an entirety of each left-side connection 152 in the stack 13 is closer to the stack left end 116 than to the longitudinal centerline 121 of the stack 13, as representatively illustrates in FIGS. 7, 9, and 10C. In other embodiments, an entirety of each connection in the stack 13 is closer to a single stack end—such as, for example, the stack right end 114—than to the longitudinal centerline 121 of the stack, as representatively illustrated in FIGS. 8 and 10D.

Figure 11:
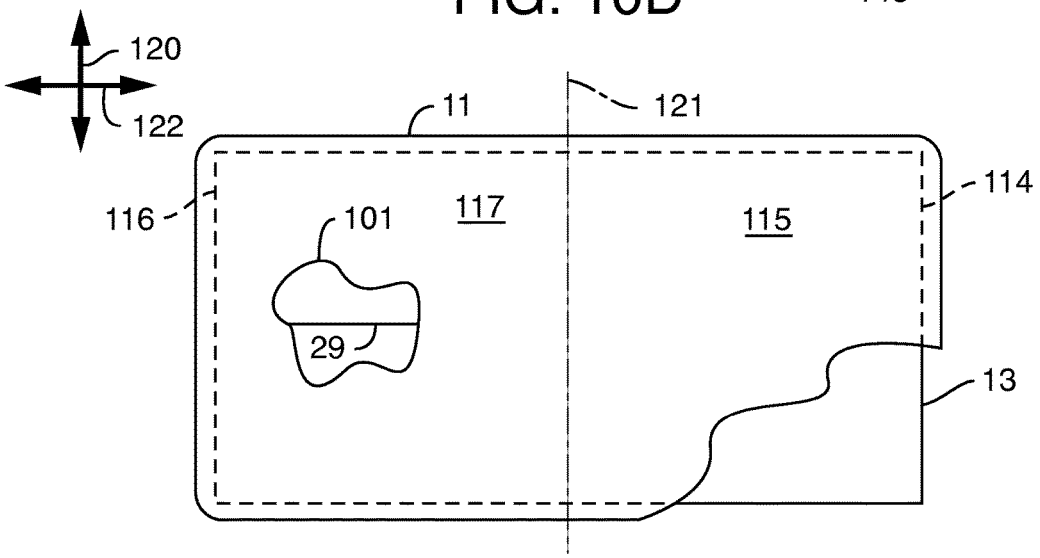
FIG. 11 representatively shows a top view of a dispenser suitable for use in conjunction with particular embodiments of the present invention, with a portion cut away to show the stack of wipes housed therein.

In particular embodiments, a dispenser 11 contains the plurality of interconnected wipes 10. The dispenser 11 and plurality of wipes 10 are together adapted to provide pop-up dispensing of the wipes. The dispenser 11 defines a dispensing orifice 111, through which wipes can be extracted from the dispenser 11. In particular embodiments, the dispensing orifice 111 is centered in the transverse direction, as in the examples of FIGS. 6 and 12. In other examples, the dispensing orifice 111 is transversely offset from the longitudinal centerline 121 of the stack of wipes 13 contained therein by at least 25 percent of the stack transverse width 113, as representatively illustrated in the example of FIG. 11 in which the orifice 111 is offset toward the left end 116 of the stack 13. Of course, the orifice 111 could alternatively be offset toward the right end 114 of the stack 13 (which could in particular embodiments be advantageous for use in conjunction with a stack of wipes in which all wipe-to-wipe connections were on the right side 115 of the stack, such as the stack 13 representatively illustrated in FIG. 10D).

In another aspect, the invention relates to a method of dispensing wipes. The method includes providing a stack of wipes 13, as representatively illustrated in FIGS. 10A-10D. The stack 13 has a first end (such as a right end 114), a second end (such as a left end 116), a transverse direction extending between the first end 114 and the second end 116, a longitudinal direction 120 perpendicular to the transverse direction 122, and a longitudinal centerline 121 extending in the longitudinal direction 120 and positioned midway between the first end 114 and second end 116. The stack defines a first side (such as right side 115) transversely between the longitudinal centerline 121 and the first end 114 and defines a second side (such as left side 117) transversely between the longitudinal centerline 121 and the second end 116.

Each wipe in the stack 13 is generally rectangular in shape, and each wipe defines four corners. For example, referring to FIG. 7, wipe 134 defines corners 70*a*/70*b*/70*c*/70*d*, and wipe 132 defines corners 72*a*/72*b*/72*c*/72*d*. In another example, referring to FIG. 8, wipe 134 defines corners 80*a*/80*b*/80*c*870*d*, and wipe 132 defines corners 82*a*/82*b*/82*c*/82*d*. The method in particular embodiments further includes providing a dispenser 11. The dispenser 11 has a dispensing orifice 101 through which wipes can be extracted from the dispenser 11.

Figure 12A:
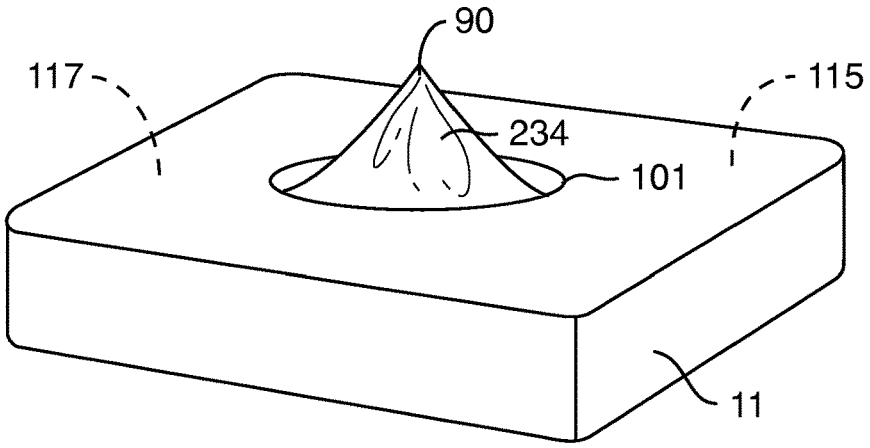
FIGS. 12A-12C representatively show three stages in one embodiment of the method aspect of the present invention.
Figure 12B:
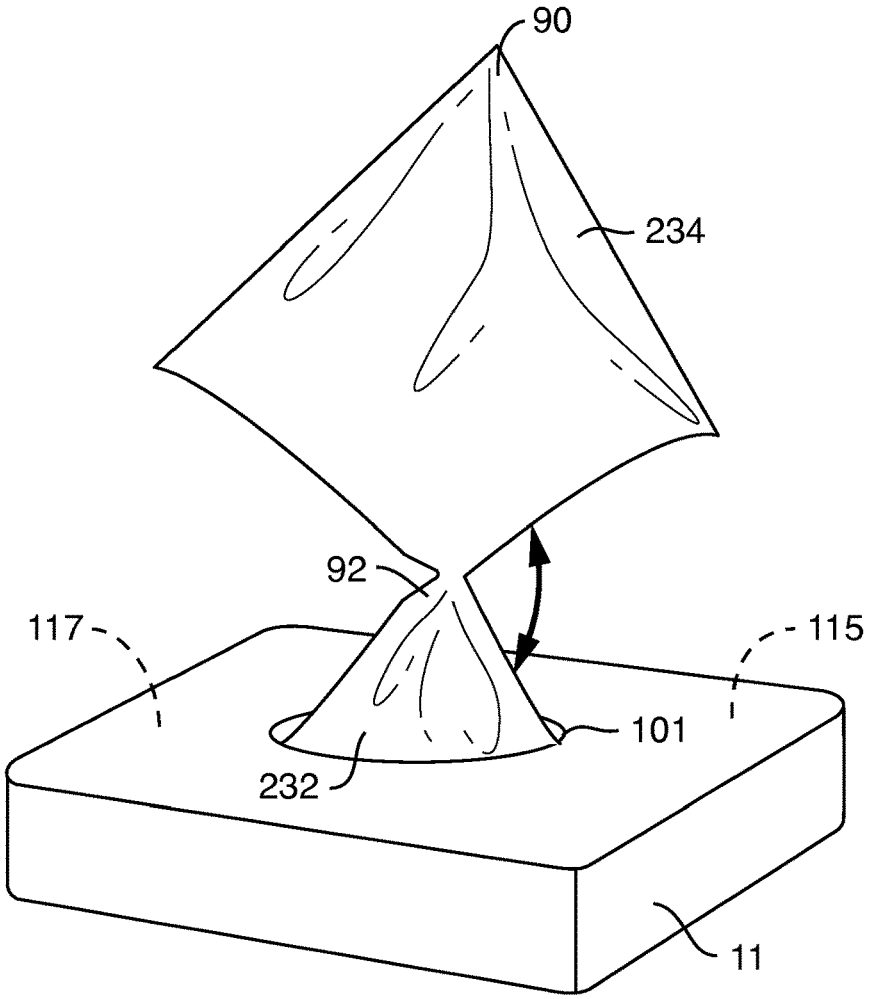
Figure 12C:
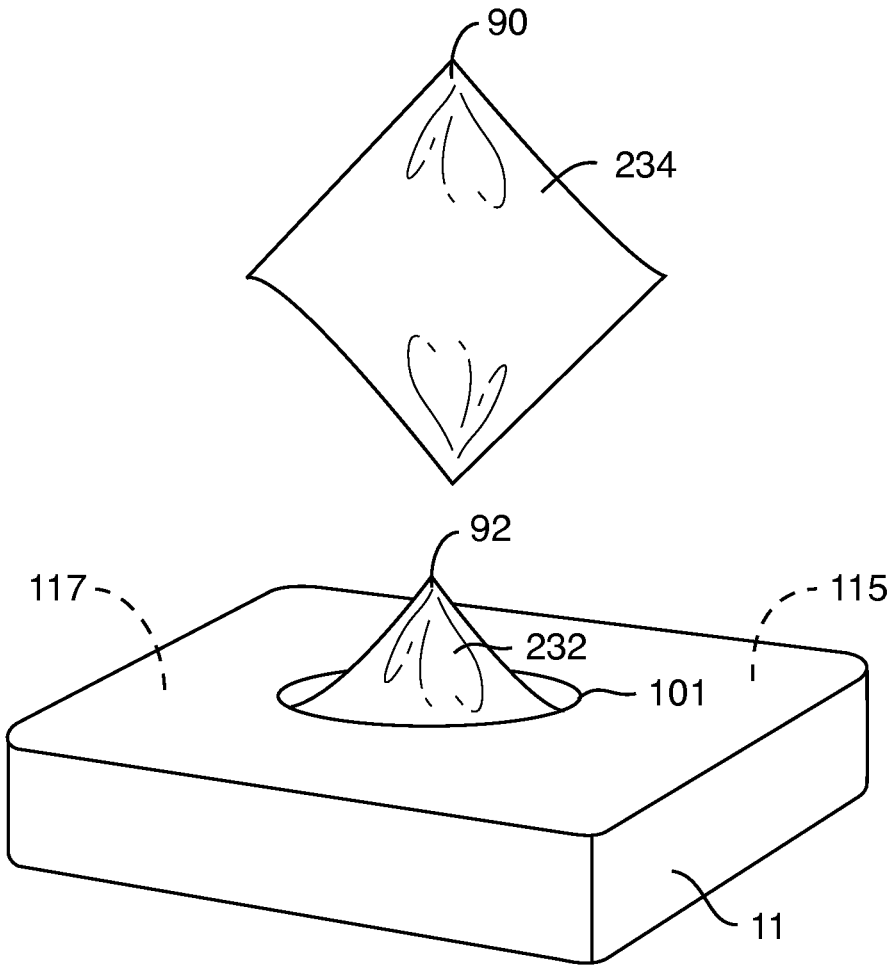

Referring to the exemplary embodiment outlined in FIGS. 12A-12C, the method can further include grasping a presented corner 90 of a leading wipe 234, and pulling the presented corner 90 of the leading wipe 234 to withdraw the leading wipe 234 out of the dispenser 11. As the leading wipe 234 is withdrawn, the leading wipe 234 releases from a succeeding wipe 232 such that a presented corner 92 of the succeeding wipe 232 protrudes from the dispensing orifice 101. No wipe corner other than the presented corner protrudes from the dispensing orifice 101. "Presented corner" as used herein means the corner of the wipe that protrudes away from the stack and through the dispensing orifice of the dispenser, so that user may readily grasp it.

In particular embodiments, the presented corner 90 of the leading wipe 234 and the presented corner 92 of the succeeding wipe 232 originate from opposite sides 115/117 of the stack 13. Preferably in such embodiments, each wipe in the stack 13 is connected to at least one other wipe on only one of the right side 115 and the left side 117 of the stack via a connection. In other words, each wipe in the stack is connected to at least one other wipe on either the right side 115 of the stack 13 or the left side 117 of the stack 13, but not on both sides. Immediately successive connections 142, 152 in a stacked direction 119 alternate from the right side 115 to the left side 117, as suggested by the embodiments shown in FIGS. 7, 9, and 10C. Preferably, each right-side connection 142 in the stack 13 is closer to the stack right end 114 than to the longitudinal centerline 121 of the stack 13, and each left-side connection 152 in the stack 13 is closer to the stack left end 116 than to the longitudinal centerline 121 of the stack 13.

For example, referring to FIGS. 12A-12C and FIG. 7, in particular embodiments of the method, the presented corner 90 of the leading wipe 234 corresponds to the corner 70*a* of the third wipe 134 in FIG. 7, and the presented corner 92 of the succeeding wipe 232 corresponds to the corner 72*b* of the second wipe 132 in FIG. 7. In such an embodiment, as the presented corner 90 (corner 70*a*) of the leading wipe 234 (wipe 134) is pulled and withdraw out of the dispenser 11, the leading wipe 234 (wipe 134) releases from the succeeding wipe 232 (wipe 132) such that a presented corner 92 (corner 72*b*) of the succeeding wipe 232 (wipe 132) protrudes from the dispensing orifice 101. The presented corner 90 (corner 70*a*) of the leading wipe 234 (wipe 134) and the presented corner 92 (corner 72*b*) of the succeeding wipe 232 (corner 132) originate from opposite sides 115/117 of the stack 13. Specifically, the corner 70*a* originates from the right side 115 of the stack, and the corner 72*b* originates from the left side 117 of the stack. Note that when corner 70*a* is the presented corner, the three remaining corners (70*b*, 70*c*, 70*d*) of wipe 134 remain inside the dispenser, such that corner 70*a*, and only corner 70*a*, is presented. Similarly, when corner 72*b* is the presented corner, the three remaining corners (72*a*, 72*c*, 72*d*) of wipe 132 remain inside the dispenser, such that corner 72*b*, and only corner 72*b*, is presented outside of the dispenser.

In other embodiments, the presented corner 90 of the leading wipe 232 and the presented corner 92 of the succeeding wipe 232 each originate from the same side of the stack (such as from the right side 115, or from the left side 117). Preferably in such embodiments, each wipe in the stack 13 is connected to at least one other wipe on only the first side 115 of the stack via a connection. Immediately successive connections 143*a*, 143*b* in a stacked direction 119 are all on the first side 115 of the stack, as suggested by the embodiments shown in FIGS. 8 and 10D. Preferably, each connection 143 in the stack is closer to the stack first end 114 than to the longitudinal centerline 121 of the stack 13.

For example, referring to FIGS. 12A-12C and FIG. 8, in particular embodiments of the method, the presented corner 90 of the leading wipe 234 corresponds to the corner 80*a* of the third wipe 134 in FIG. 8, and the presented corner 92 of the succeeding wipe 232 corresponds to the corner 82*a* of the second wipe 132 in FIG. 8. In such an embodiment, as the presented corner 90 (corner 80*a*) of the leading wipe 234 (wipe 134) is pulled and withdraw out of the dispenser 11, the leading wipe 234 (wipe 134) releases from the succeeding wipe 232 (wipe 132) such that a presented corner 92 (corner 82*a*) of the succeeding wipe 232 (wipe 132) protrudes from the dispensing orifice 101. The presented corner 90 (corner 80*a*) of the leading wipe 234 (wipe 134) and the presented corner 92 (corner 82*a*) of the succeeding wipe 232 (corner 132) originate from the same side of the stack 13. Specifically, the corner 80*a* originates from the right side 115 of the stack, and the corner 82*a* originates from the right side 115 of the stack. Note that when corner 80*a* is the presented corner, the three remaining corners (80*b*, 80*c*, 80*d*) of wipe 134 remain inside the dispenser, such that corner 80*a*, and only corner 80*a*, is presented. Similarly, when corner 82*a* is the presented corner, the three remaining corners (82*b*, 82*c*, 82*d*) of wipe 132 remain inside the dispenser, such that corner 82*a*, and only corner 82*a*, is presented outside of the dispenser.

The structures and methods described above can in particular embodiments deliver a number of useful features. First, the mechanism of dispensing just described can present a corner of the next wipe in the stack to the user, which offers certain accessibility benefits in certain applications. Second, due to the way the wipe tips to the side, or "deforms" into a general "diamond-like" shape, the variability in dispensing force can be better controlled, making dispensing more reliable and predictable (such as by reducing the undesirable "fall backs" or "multiples" described earlier). Third, the force required to dispense a wipe is in particular embodiments of the present invention lower than in many conventional configurations, which desirably allows more wipes to be dispensed from a dispenser before the dispenser (often made of relatively light polymers) begins to lift off the surface on which it rests. Finally, the pop-up dispensing configuration described herein reduces tearing of the wipes, due to the fact, it is believed, that vector forces are oriented "diagonally" from corner to corner, as opposed to purely in a machine direction or cross-machine direction (one or both of which may be weaker than the "diagonal" direction).

Without wishing to limit the scope of the invention as claim, it is theorized that, in particular embodiments of the invention, rotation of the succeeding wipe of about 45 degrees (sheet 32 in FIGS. 5 and 6; sheet 232 in FIG. 12) causes the succeeding wipe 32/232 to bunch, and to have a non-uniform profile in the direction of dispensing as it passes through the dispensing orifice. For the 45-degree rotated wipe 32/232, its thickest section (bunched in the diagonal direction of a roughly square sheet) encounters the dispensing orifice when the sheet 32 is about half-dispensed, such that the resistance of the wipe to dispensing is greatest at this "half dispensed" point in time. This varying force of resistance to dispensing helps retain the succeeding wipe 32 near mid-dispense, thus helping to reduce fallbacks or multiples.

Materials suitable for the wipes of the present invention are well known to those skilled in the art. Wipes, such as pre-moistened wipes, can be made from, for example, melt-blown, coform, air-laid, bonded-carded, or hydroentangled materials, high wet-strength tissue, or combinations thereof, such as layered combinations thereof. The wipes can comprise synthetic or natural fibers or combinations thereof. Wipes suitable for use in conjunction with the present invention can contain a liquid which can be any solution that can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments, and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe for improved wiping. Examples of wipe substrates suitable for use in conjunction with the present invention include U.S. Pat. No. 5,508,102 A, U.S. Pat. No. 7,585,797 B2, and U.S. Pat. No. 8,257,553 B2.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims.

We claim:

1. A plurality of stacked, interconnected wipes that collectively define a stack, the stack having a right end, a left end, a transverse direction extending between the right end and the left end, a longitudinal direction perpendicular to the transverse direction, and a longitudinal centerline extending in the longitudinal direction and positioned midway between the right and left ends, the stack defining a right side transversely between the longitudinal centerline and the right end and defining a left side transversely between the longitudinal centerline and the left end, wherein each wipe is connected to at least one other wipe on the right side of the stack via a connection, wherein immediately successive connections in a stacked direction are on the same side of the stack and overlap in the transverse direction.

2. The plurality of stacked, interconnected wipes of claim 1, wherein a majority of connections in the stack are integrally formed with a wipe.

3. The plurality of stacked, interconnected wipes of claim 1, wherein no connection in the stack is integrally formed with a wipe.

4. The plurality of stacked, interconnected wipes of claim 3, wherein each connection is accomplished via ultrasonic bonding, heat bonding or pressure bonding.

5. The plurality of stacked, interconnected wipes of claim 1, wherein an entirety of each right-side connection in the stack is closer to the stack right end than to the longitudinal centerline of the stack.

6. The plurality of stacked, interconnected wipes of claim 1, wherein immediately successive connections in a stacked direction fully overlap in the transverse direction.

7. The plurality of stacked, interconnected wipes of claim 1, wherein immediately successive connections in a stacked direction are spaced the same distance from the right end.

8. A plurality of stacked, interconnected wipes that collectively define a stack, the stack having a right end, a left end, a transverse direction extending between the right end and the left end, a longitudinal direction perpendicular to the transverse direction, and a longitudinal centerline extending in the longitudinal direction and positioned midway between the right and left ends, the stack defining a right side transversely between the longitudinal centerline and the right end and defining a left side transversely between the longitudinal centerline and the left end, the plurality of wipes comprising a first wipe, a second wipe, and a third wipe, wherein a first right-side connection connects the first wipe to the second wipe in the right side of the stack, wherein the first right-side connection has an effective width extending in the transverse direction, the first wipe being connected to the second wipe only on the right side, and wherein a second right-side connection connects the second wipe to the third wipe in the right side of the stack, wherein the second right-side connection has an effective width extending in the transverse direction, the second wipe being connected to the third wipe only on the right side, wherein the first right-side connection and the second right-side connection overlap in the transverse direction.

9. The plurality of stacked, interconnected wipes of claim 8, wherein a majority of connections in the stack are integrally formed with a wipe.

10. The plurality of stacked, interconnected wipes of claim 8, wherein no connection in the stack is integrally formed with a wipe.

11. The plurality of stacked, interconnected wipes of claim 10, wherein each connection is accomplished via ultrasonic bonding, heat bonding or pressure bonding.

12. The plurality of stacked, interconnected wipes of claim 8, wherein the first right-side connection effective width and the second right-side connection effective width are each at most 10 percent of a stack transverse width.

13. The plurality of stacked, interconnected wipes of claim 8, wherein an entirety of each connection in the stack is closer to the stack right end than to the longitudinal centerline of the stack.

14. The plurality of stacked, interconnected wipes of claim 8, wherein the majority of connections each include from 3 to 8 bridging strips.

15. The plurality of stacked, interconnected wipes of claim 8, wherein the first right-side connection and the second right-side connection fully overlap in the transverse direction.

16. The plurality of stacked, interconnected wipes of claim 8, wherein the first right-side connection and the second right-side connection are spaced the same distance from the right end.

* * * * *